US006213357B1

(12) United States Patent
Collura

(10) Patent No.: US 6,213,357 B1
(45) Date of Patent: Apr. 10, 2001

(54) NOZZLE EXCHANGER

(75) Inventor: Mariano Collura, Strepy Bracquegnies (BE)

(73) Assignee: Vesuvius Group SA, Brain-Lálleud (BE)

( * ) Notice: Subject to any disclaimer, the term of this patent is extended or adjusted under 35 U.S.C. 154(b) by 0 days.

(21) Appl. No.: 09/395,660

(22) Filed: Sep. 14, 1999

(30) Foreign Application Priority Data

Mar. 14, 1997 (FR) ..... 97 03137
Mar. 9, 1998 (WO) ..... PCT/IB98/00387

(51) Int. Cl.[7] ..... B22D 41/24
(52) U.S. Cl. ..... 222/607; 222/606
(58) Field of Search ..... 222/600, 606, 222/607; 266/236, 287

(56) References Cited

U.S. PATENT DOCUMENTS 4,669,528 6/1987 Szadkowski .
4,854,488 * 8/1989 Trenkle et al. ..... 222/607
5,170,915 12/1992 Szadkowski .
5,351,865 * 10/1994 Szadkowski et al. ..... 222/607

FOREIGN PATENT DOCUMENTS

0441927 B1 * 8/1990 (EP) .

* cited by examiner

*Primary Examiner*—Scott Kastler
(74) *Attorney, Agent, or Firm*—James R. Williams

(57) ABSTRACT

The invention concerns a valve assembly, an admission path for a pouring nozzle adjacent to the outlet of the valve, and spring thrusters for maintaining this nozzle in operating position on the admission path and for receiving another nozzle in ready position. The device also comprises a traverser with offset jack, provided with an arm for driving the nozzles, while being supported by the cam track. The invention is characterized in that the jack body is provided at the top with a sensor co-operating with this cam track, and also supports the driving arm, while the jack rod is fixed to the frame, thereby reducing the space requirement of the device.

5 Claims, 2 Drawing Sheets

NOZZLE EXCHANGER

The invention relates to continuous hot casting installations which serve in particular for making raw steel products.

An essential element of such an installation is the casting member which is known as an immersed nozzle. Mounted on a metallurgical or casting container, it ensures good distribution of the flow of liquid metal, which must ultimately abut against a continuous casting channel, where a cooling and progressive solidification of the liquid metal take place. All the components in contact with the metal at a high temperature are naturally made of refractory material. They are likewise subject to wear or blockage, in particular the nozzle, which has to be changed periodically in order to prolong the casting cycle.

Furthermore the close presence of the hot metal creates a very difficult environment for all the systems which are provided. All handling is delicate in this region. The zones in question are also congested and often tight. The metallurgical containers and the distributors of the continuous casting in particular are often provided with feet or reinforcements on their bases.

In European patent EP-B-0 441 927, the applicants have proposed a device for plugging and controlling continuous hot casting designed to be mounted on a metallurgical or casting container of the type comprising, on a framework, a plugging assembly, a channel providing a casting tube known as an immersed nozzle, adjacent to the outlet of the plug, spring thrusters to maintain this nozzle in an operative position in line with the plug assembly, on the feed channel, which is designed to receive another nozzle in a position of readiness, and an offset ram traverser provided with an arm for engaging the nozzles, all supported on a cam track.

It would seem difficult to improve on it, in particular to make it more compact. However the present invention aims to improve these items still further.

According to one important aspect of the invention the body of the ram is provided with a sensor designed to co-operate with the cam track and it also supports the driving arm, whereas the rod of the ram is fixed to the structure. This allows a reduction in the dimensional bulk of the device.

Preferably the ram is retracted while a nozzle is in operation, whereas it is extended for displacing the nozzles by pushing on them.

Other features and advantages of the invention will become apparent from a study of the detailed description which follows, together with the accompanying drawings, in which:

The accompanying drawings disclose elements of a certain character. They can thus serve not only to provide a better understanding of the description, but also to contribute to defining the invention.

Figure 3:
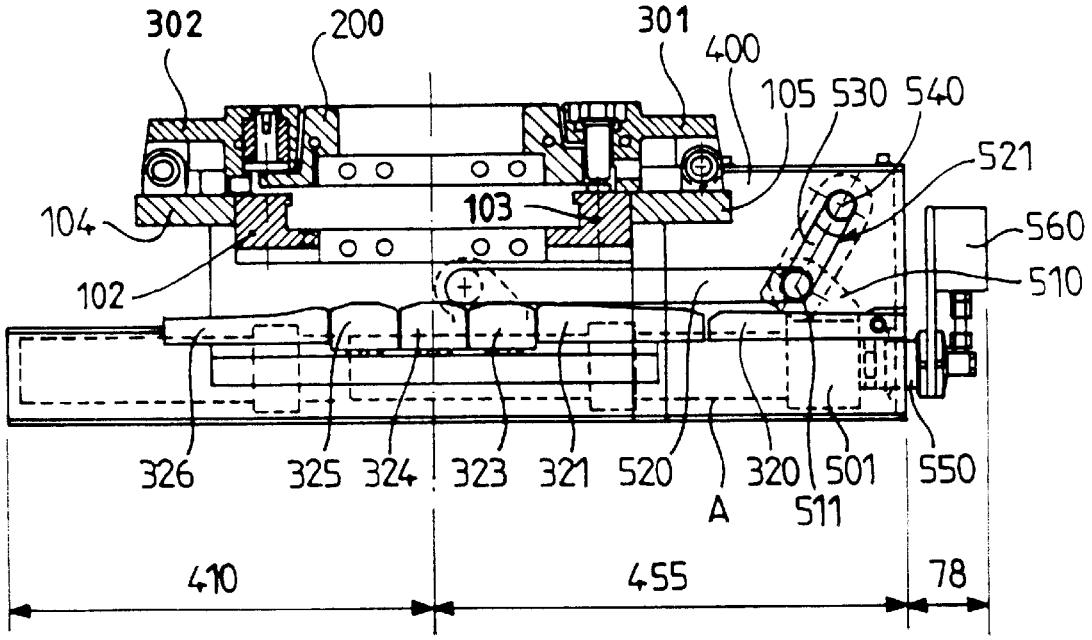
FIG. 3 is a vertical section on the line III—III in FIG. 1.

The framework of the device is defined by longitudinal beams 102 and 103, joined together on the right by a transverse beam 101 (FIG. 1) and lying over lower parallel beams 104 and 105 (FIG. 3). On the left (in FIG. 3) the location of the beams is ensured by an assembly comprising guide elements of a ram body 504 and a frame 106.

Figure 2:
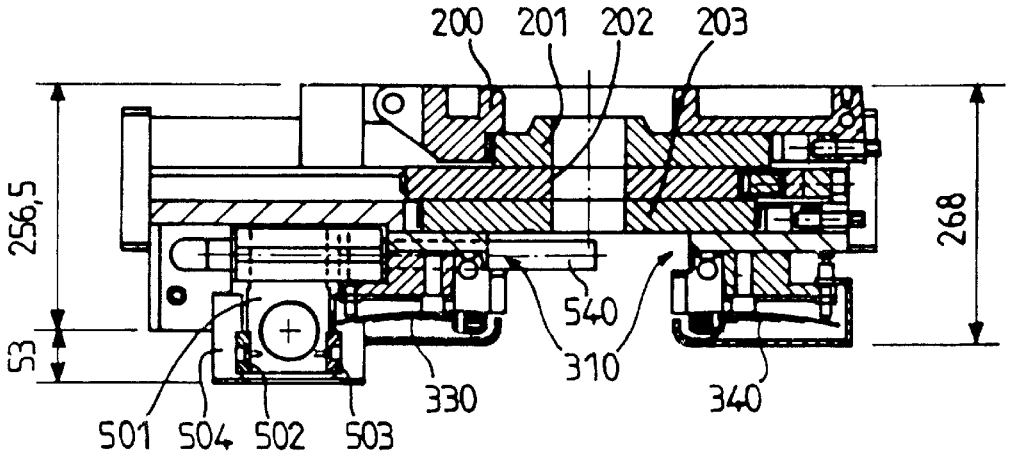
FIG. 2 is a vertical section on the line II—II in FIG. 1.

Above the structure there is provided a cover 200 enclosing a refractory member 201 (FIGS. 2 and 3). This member

201 ensures a connection with the refractory of the container under which the device is mounted, in a known manner. Underneath there are provided two other superposed refractory plates 202 and 203. Forming an assembly of three refractory plates with the central plate 202, the plates 201 and 203 are fixed whereas the plate 202 can slide between the plates 201 and 203. The central plate 202 moves on the command for the nozzle to deliver with the aid of a ram control mechanism, not illustrated here (see EP-B-0 441 927). The plate 202 is located within a moving frame capable of sliding between the elements 104 and 105 of the framework (FIG. 3). The covers 301 and 302, provided with resilient sealing means, serve to ensure the sealing between the refractory plates 201 to 203.

The feed track of the nozzles is visible in end view at 310 in FIG. 2. In FIG. 3 can be seen one of the guiding profiles designed to co-operate with one of the straight edges of the nozzle flange: at 320 and 321 slightly rising profiles, then the thrusters 323 to 325 (elastic returns for example at 330 and 340 in FIG. 2), and finally an exit profile 326 which falls once again.

Mounted at the edge of the device are bevels such as 400 (FIG. 3) which support and guide the mechanism for displacing the nozzles.

The latter comprises a ram body 501 (FIG. 2) mounted to slide on bronze pads 502 and 503 in a U-shaped location identified as 504. The head of this ram body has a claw 510 (FIG. 3) provided with a lateral spur-sensor 511 which follows a horizontal cam track 520. In addition there is pivotally connected to the claw 510, preferably co-axially with the spur 511, a block 530 articulated around the spur sensor 511 which can furthermore co-operate with a complementary oblique portion of the cam track. And, at the free end of this articulated rod there is mounted a driving arm 540, seen in section in FIG. 3 but visible in FIG. 2 in the nozzle supply path (not shown).

The end of the rod of the ram is visible at 550 in FIG. 3, where it is surmounted by the hydraulic feed system 560. This system communicates with the rod to provide hydraulic supply to the ram. The rod is mounted fixed or pivoted on the structure with freedom for at least partial angular deflection (about a horizontal axis).

Figure 1:
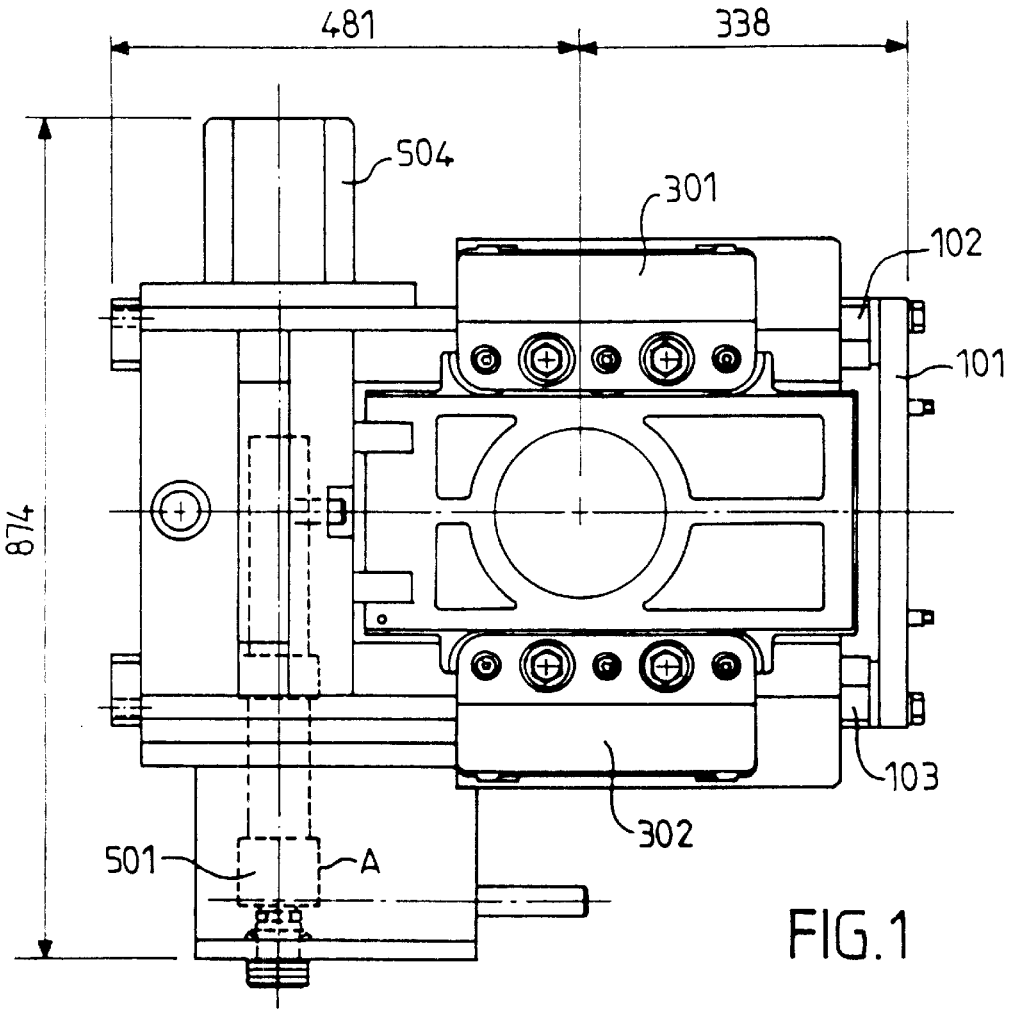
FIG. 1 is a simplified plan view of a nozzle device according to the invention.

When a nozzle (not shown) is in operation the ram is retracted and is present in the position A (FIGS. 1 and 3). The driving arm is situated above the cam track 521, and permits introduction of a fresh nozzle without necessarily raising the distributor. On the side where the head of the ram is present, the fresh nozzle waits on the feed track in contact with the operative nozzle. After this, at the moment when one wishes to exchange the nozzles, the ram is caused to extend, it pushes the two nozzles together in such a way that the new one comes into the operative position whereas the previous one leaves to the left (FIG. 3) and can then be withdrawn from the steel bath in a known manner. After this the ram can return to its retracted position.

The arrangement described above is particularly compact. In particular the operation of the ram contributes to its compactness since an important part of the path of the body of the ram takes place within the dimensions of the remainder of the device. Moreover it allows very rapid changing of the nozzle, which is essential. Furthermore this changing takes place when the ram is extended, such as to allow an operator to provide reduced pressure forces. Finally the disposition of the ram within the arrangement ensures better protection, in particular of the rod of the ram, in relation to the heat given off by the molten metal.

What is claimed is:

1. A nozzle changing mechanism for continuously casting steel from a distributor into a mold, the mechanism having dimensions and comprising:

an operative position capable of accepting a first nozzle so that the first nozzle is fluidly connected to an outlet of the distributor;

a ready position adjacent to the operative position and capable of accepting a second nozzle;

a driving arm mounted on a cam track and capable of traversing the cam track; and a ram connected to the driving arm and having a principal dimension, a rod, and a spur sensor cooperating with and following the cam track and leading the driving arm, the ram capable of moving the driving arm along the cam track so that the driving arm moves the second nozzle from the ready position to the operative position while simultaneously moving the first nozzle from the operative position, the ram further being fixed to the mechanism to reduce the dimensions of the mechanism.

2. The mechanism of claim 1, wherein the ram is extended in the principal dimension to move the second nozzle from the ready position to the operative position.

3. The mechanism of claim 1, wherein the driving arm is rigidly connected to the sensor, and the sensor is mounted on an articulated rod portion that permits the driving arm to move so that the driving arm does not obstruct loading of the second nozzle into the ready position.

4. The mechanism of claim 1, wherein the ram is slideably mounted in the mechanism and the rod of the ram is capable of at least partial angular deflection.

5. The mechanism of claim 1, wherein the mechanism includes a slide gate device interposed between the distributor and the operative position, the slide gate device comprising at least two plates in compressive relationship, including a first plate having an orifice capable of fluidly connecting with the outlet of the distributor, and a second plate having an orifice capable of fluidly connecting with the orifice of the first plate, at least one plate capable of translating in a direction perpendicular to the principal dimension of the ram, whereby the orifices of the plates can align, thereby forming a casting channel fluidly connected with the operative position.

* * * * *